US005996592A

United States Patent [19]

Choy

[11] Patent Number: 5,996,592

[45] Date of Patent: Dec. 7, 1999

[54] CUTTING TOOL HAVING MULTIPLE SCISSORS

[76] Inventor: Bruce W. Choy, 3818 Pacheco St., San Francisco, Calif. 94116

[21] Appl. No.: 09/239,464

[22] Filed: Jan. 28, 1999

[51] Int. Cl.[6] ..... A45D 24/00

[52] U.S. Cl. ..... 132/200; 132/213; 30/226

[58] Field of Search ..... 132/212, 213, 132/214, 215, 200; 30/226, 227, 229, 260, 254; D8/5, 57

[56] References Cited

U.S. PATENT DOCUMENTS

| | | | |
|---|---|---|---|
| 550,483 | 11/1895 | Carrier | 30/226 |
| 932,472 | 8/1909 | Jewart | 30/229 |
| 1,012,918 | 12/1911 | Roelants et al. | 30/229 |
| 1,345,882 | 7/1920 | Repass | 30/229 |
| 2,840,905 | 7/1958 | Geiger | 30/226 |
| 5,600,891 | 2/1997 | Orgal | 30/226 |

*Primary Examiner*—Gene Mancene
*Assistant Examiner*—Pedro Philogene
*Attorney, Agent, or Firm*—Skjerven, Morrill, Macpherson, Franklin & Friel, LLP; Edward C. Kwok

[57] ABSTRACT

A cutting tool includes first, second and third pairs of scissors. The first and third pairs of scissors are spaced apart from the second pair of scissors by a fixed distance. Each pair of scissors includes a first elongated member and a second elongated member pivotally coupled to the first elongated member. Each elongated member has a handle portion and a cutting portion, including a cutting blade. The cutting tool further includes spacing elements disposed between each pair of scissors to offset the pairs of scissors from each other. A retaining member is coupled to the first elongated member of each pair of scissors to secure the first elongated members together. The second elongated member of each pair of scissors, however, is movable independent of the other scissors. The cutting tool is ideally suited for cutting and styling hair when dry.

20 Claims, 2 Drawing Sheets

CUTTING TOOL HAVING MULTIPLE SCISSORS

FIELD OF THE INVENTION

The present invention relates to cutting tools. More particularly, the present invention relates to a cutting tool for cutting and styling hair.

BACKGROUND

Conventional cutting tools for cutting hair are well-known. These cutting tools typically include a single pair of scissors having straight edge cutting blades. Although it is easy to achieve a blunt, straight cut with these single pair scissors, it is more difficult to layer, texturize, or thin hair with them. A single pair of scissors cuts only a small amount of hair at a time, making it difficult to determine after a single cut which area has been layered, texturized or thinned. Other cutting tools, including a single pair of scissors having jagged edge cutting blades, are used in conjunction with straight edge scissors. Typically, when cutting and styling a person's hair, a hair stylist first wets the person's hair and cuts it using the straight edge scissors to provide a blunt, straight cut. Next, the stylist layers, texturizes or thins the person's hair using the jagged edge scissors. The stylist then blow dries the hair and completes the haircut by trimming any unfinished areas. This process has several disadvantages. First, because the majority of the haircut occurs while the person's hair is wet, the person and the stylist are unable to visualize the final haircut until it is dry. Thus, the person is unable to provide input or feedback to the stylist until the end. It is also difficult for the stylist to layer, texturize or thin the person's hair evenly with a single pair of scissors. In addition, the numerous steps in this process, including washing and drying the hair and cutting it with the various tools, are rather time consuming.

One prior approach aimed at reducing the cutting time is a cutting tool having a combination of two or more pairs of scissors. In the past these multiple scissors tools have not been very successful. Both handles of each pair of scissors are permanently secured to respective handles of adjacent pairs of scissors. As a result, adjacent pairs of scissors exert a force on each other such that the cutting blades of one or more pairs of scissors will not close properly.

There is a need, therefore, for a versatile cutting tool which enables a hair stylist and a client to picture the final haircut throughout the entire cutting and styling process. In addition, there is a need for a cutting tool capable of cutting and styling dry hair in either a straight or layered cut faster than a single pair of scissors. It is also desirable for the cutting tool to layer, texturize or thin the hair evenly.

SUMMARY

The present invention addresses these problems by providing a cutting tool having multiple pairs of scissors. The multiple pairs of scissors enable the cutting tool to cut and style a person's hair in a shorter amount of time and to layer, texturize or thin the hair more evenly. In addition, the cutting tool facilitates cutting and styling dry hair, which enables both the stylist and the person to visualize the final haircut throughout its creation.

In accordance with one embodiment of the invention, a cutting tool includes three pairs of scissors. The second pair of scissors is offset from the first pair of scissors by a first distance, and the third pair of scissors is offset from the second pair of scissors by a second distance. Each pair of scissors of the cutting tool is movable independent of the other pairs of scissors.

In accordance with another embodiment of the invention, a cutting tool includes first, second and third pairs of scissors offset from each other as described above. Each pair of scissors includes a first elongated member and a second elongated member pivotally coupled to the first elongated member. Each elongated member has a handle portion and a cutting portion including a cutting blade. The cutting tool further includes a retaining member coupled to each pair of scissors to secure them together. The retaining member is coupled to the first elongated member of each pair of scissors, such that the second elongated member of each pair of scissors is movable independent of the other pairs of scissors.

In accordance with still another embodiment of the invention, a method of cutting and styling hair includes directing a cutting tool along the length of a section of hair and cutting a portion of the section of hair. The cutting tool includes at least three pairs of scissors spaced apart in parallel. The method further includes rotating the cutting tool such that the at least three pairs of scissors are transverse to the section of hair and cutting another portion of the section of hair, so that hair along an inner portion of the section is longer than hair along an outer portion of the section.

BRIEF DESCRIPTION OF THE DRAWINGS

The present invention may be better understood, and its numerous objects, features, and advantages made apparent to those skilled in the art by referencing the accompanying drawings.

The use of the same reference symbols in different drawings indicates similar or identical items.

DETAILED DESCRIPTION

Figure 1:
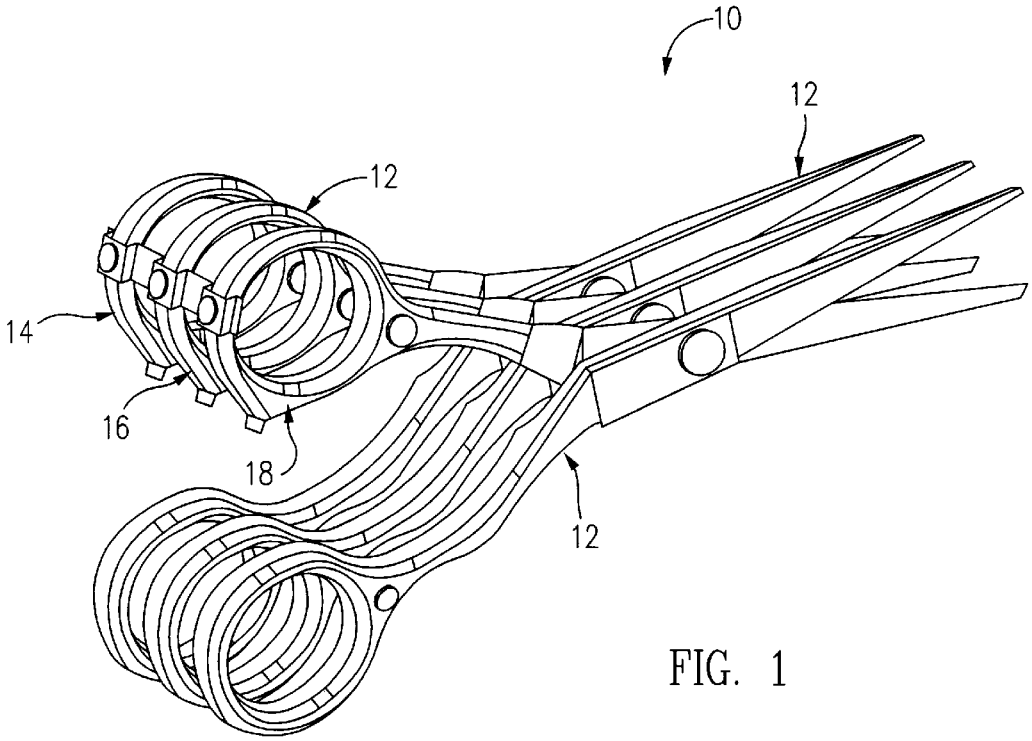
FIG. 1 is a front perspective view of a cutting tool in accordance with one embodiment of the present invention, illustrating three pairs of scissors.

FIG. 1 illustrates a cutting tool 10 in accordance with one embodiment of the present invention. The cutting tool 10 is preferably used for cutting and styling hair, but may be used for other applications as well. The cutting tool 10 includes a plurality of pairs of scissors 12. In the present embodiment, the cutting tool 10 includes first, second and third pairs of scissors 14, 16 and 18 spaced apart in parallel.

Figure 2:
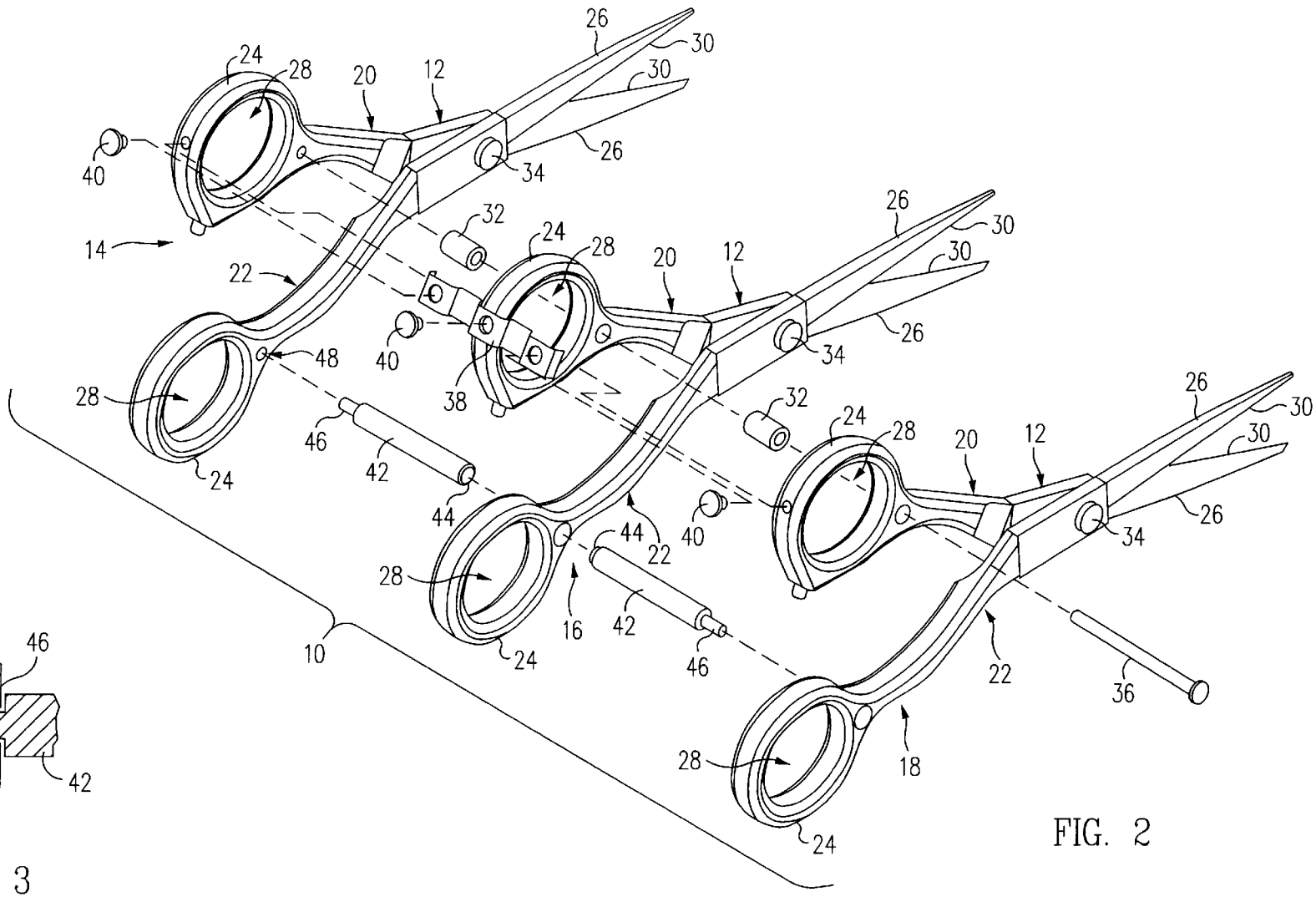
FIG. 2 is an exploded perspective view of the cutting tool of FIG. 1.
Figure 3:
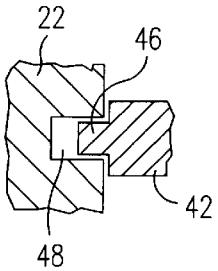
FIG. 3 is a partial sectional view illustrating the detached end of a standoff element of the cutting tool of FIG. 2.

As illustrated in greater detail in FIG. 2, each pair of scissors 12 includes a first elongated member 20 and a second elongated member 22. The second elongated member 22 is pivotally coupled to the first elongated member 20. Each elongated member 20 and 22 has a handle portion 24 at one end and a cutting portion 26 at the other end. The handle portion 24 has an opening 28 formed therein. The opening 28 of the first elongated member 20 is adapted to receive a user's thumb, while the opening 28 in the second elongated member 22 is adapted to receive the user's index finger, thereby enabling the user to control the cutting tool 10 during a cutting operation. The cutting portion 26 of the elongated members 20 and 22 includes a cutting blade 30. Thus, the cutting blade 30 of the first elongated member 20 cooperates with the cutting blade 30 of the second elongated member 22 to cut hair or any other material.

The first pair of scissors 14 is offset from the second pair of scissors 16 by a spacing element 32. The spacing element 32 is coupled to the first elongated member 20 of the first and second pairs of scissors 14 and 16, respectively. In the preferred embodiment, the spacing element 32 is mounted on the handle portion 24 of the first elongated member 20. In the alternative, the spacing elements 32 may be mounted at other locations along the pairs of scissors 12, including at a pivot point 34 of the scissors 12. One advantage to mounting the spacing elements 32 at a location other than at the pivot points 34, is that if one pair of scissors needs adjustment, that pair of scissors may be adjusted individually, without having to separate the pairs of scissors 12 from each other. The third pair of scissors 18 is similarly offset from the second pair of scissors 16. A bolt 36 secures the spacing elements 32 to the first elongated members 20 of the pairs of scissors 12 together. In the preferred embodiment of the invention, the spacing element between the first and second pairs of scissors and the spacing element between the second and third pair of scissors are of the same length. The spacing elements may also be of different lengths, thereby positioning the first and third pairs of scissors at different distances from the second pair of scissors.

Also mounted to the first elongated members 20 of the pairs of scissors 12 is a retaining member 38. As illustrated in FIG. 2, the retaining member 38 is coupled to the handle portion 24 of the first elongated member 20 of scissors 12, on the opposite side of the opening 28 from the spacing elements 32. Fasteners 40, such as screws or rivets, secure the retaining member 38 to the scissors 12. Alternatively, the retaining member may be welded or secured to the scissors 12 by an adhesive. The retaining member 38 cooperates with the spacing elements 32 to prevent the outermost end of the handle portion of the first elongated members of the first and third pairs of scissors from moving toward or away from the second pair of scissors.

Figure 4:
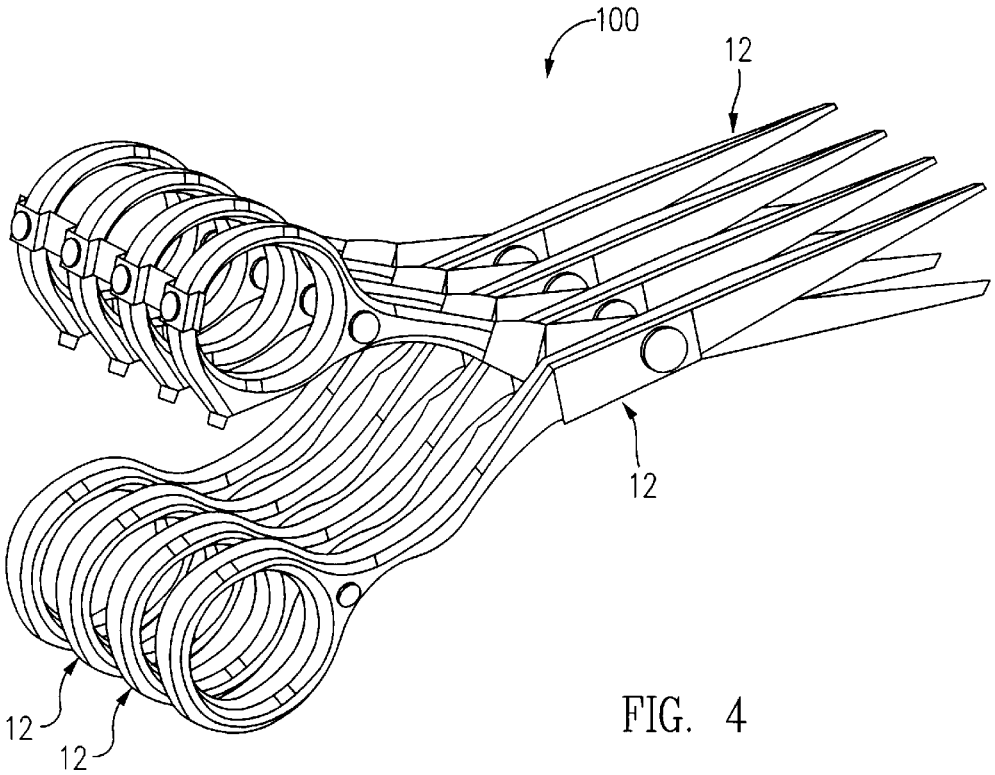
FIG. 4 is a front perspective view of a cutting tool in accordance with another embodiment of the present invention, illustrating four pairs of scissors.

The cutting tool 10 further includes standoff elements 42. Standoff elements 42 preferably include threaded bolts. A first end 44 of each standoff element 42 is mounted to the handle portion 24 of the second elongated member 22 of the second pair of scissors 16. A second end 46 of each standoff element 42 is removably received in an opening 48 formed in the second elongated member 22 of the first or third pair of scissors 14 and 18, respectively. As illustrated in FIG. 4, the second end 46 of each standoff element 42 extends only partway into opening 48, so that the standoff element 42 may be easily removed from the opening 48 to detach the second elongated member 22 of the first and/or third pairs of scissors 14 and 18, respectively, from the second pair of scissors 16. Thus, the standoff elements 42 removably attach the second elongated members of the first, second and third pairs of scissors so that they open and close simultaneously.

The arrangement of standoff elements 42 is advantageous for at least a couple of reasons. First, because the second elongated members of the pairs of scissors are not permanently locked together, no transverse force is exterted by adjacent pairs of scissors to cause misalignment of the cutting blades in either pair. Second, the threaded bolt of the standoff element 42 enables adjustment of the length of the standoff element 42. Wear or gripping forces exerted by the user may require adjustment of standoff elements 42 to ensure proper operation of the tool 10. The second elongated members 22 of the pairs of scissors may be separated from each other for repair and fine tuning. In addition, it may be desirable for one or more pairs of scissors 12 to move independent of each other, the second end 46 of the standoff element 42 can be removed from the opening 48 in the first and/or third pairs of scissors 14 and 18, respectively, enabling the second elongated member 22 of the first and/or third pairs of scissors 14 to move independent of the second pair of scissors 16.

FIG. 4 illustrates a cutting tool 100 in accordance with a second embodiment of the invention. The cutting tool 100 includes four pairs of scissors 12 coupled together in a manner similar to that described above with respect to cutting tool 10.

The cutting tools 10 and 100, therefore, operate as follows. In order to form a straight cut, a hair stylist holds the cutting tool 10 or 100 such that the pairs of scissors 12 extend parallel to the hair with the tips of the cutting portions of the scissors at the bottom end of the hair. By moving the cutting tool back and forth along a direction perpendicular to the length of hair and cutting, the stylist can achieve a straight cut. This straight cut is less blunt than that formed by a single pair of scissors cutting transverse to the length of hair.

In addition to cutting hair straight across, the cutting tools 10 and 100 of the present invention can layer, texturize or thin hair. Layering or texturizing results in shorter strands of hair on the outside and longer strands of hair on the inside, closer to the person's head and neck. Thinning involves reducing the thickness or volume of hair while generally maintaining a particular length. The stylist holds the cutting tool 10 or 100 such that the pairs of scissors extend parallel to the hair. To layer or texturize a section of hair, the stylist runs just the tips of the cutting blades of the scissors along the length of hair, from the top of the hair toward the bottom while cutting. By extending the cutting portion of the scissors further into the hair and directing the middle portion of the cutting blades along the length of hair, while cutting, the stylist can thin out a section of hair. The multiple pairs of scissors of cutting tool 10 or 100 provide a more even layered, texturized or thinned haircut.

The cutting tools 10 and 100 may also be used with the scissors 12 generally transverse to the strands of hair. The stylist first rotates the cutting tool 10 or 100 such that the pairs of scissors 12 are stacked on top of each other. Next, the stylist tilts the cutting tool upward and cuts along the bottom portion of a section of hair. This method results in longer hair along an inner portion of the section of hair, closer to the person's head and neck, and shorter hair along an outer portion of the section. For any of the above described cutting techniques, the person's hair is preferably not wet or damp. This enables both the stylist and the person to visualize the haircut throughout its formation. In addition, the use of the cutting tool 10 or 100 reduces the amount of time required to cut and style a person's hair, because multiple pairs of scissors cut the hair at one time. The cutting tool 10 or 100 is a versatile tool capable of cutting hair straight across as well as layering, texturizing and thinning it.

While the present invention has been described with reference to specific embodiments, the description is illustrative of the invention and is not to be construed as limiting the invention. For example, although spacing elements 32 and retaining member 38 are shown coupled to the first elongated members 20 of scissors 12, they may instead be mounted to second elongated member 22. Various modifications may occur to those skilled in the art without departing from the true spirit and scope of the invention as defined by the appended claims.

What is claimed is:

1. A cutting tool comprising:

a first pair of scissors;

a second pair of scissors offset from the first pair of scissors by a first distance, a third pair of scissors offset from the second pair of scissors by a second distance; and means for connecting said first, second and third pairs of scissors together, wherein each pair of scissors is movable independent of the other pairs of scissors.

2. The cutting tool of claim 1, wherein the first distance is equal to the second distance.

3. The cutting tool of claim 1, wherein each pair of scissors comprises:

a first elongated member including a handle portion and a cutting portion, the cutting portion including a cutting blade; and a second elongated member pivotally coupled to the first elongated member, the second elongated member including a handle portion and a cutting portion, the cutting portion including a cutting blade.

4. The cutting tool of claim 3, further comprising:

a first spacing element disposed between the first and second pairs of scissors to offset the second pair of scissors from the first pair of scissors; and a second spacing element disposed between the second and third pairs of scissors to offset the third pair of scissors from the second pair of scissors.

5. The cutting tool of claim 4, wherein the spacing elements are coupled to the handle portions of the first elongated members of the pairs of scissors.

6. The cutting tool of claim 3, further comprising a retaining member coupled to the handle portion of the first elongated member of each pair of scissors to secure the first elongated member of each pair of scissors together.

7. The cutting tool of claim 3, further comprising a stand off element mounted at one end to the second elongated member of the second pair of scissors and removably coupled at the other end to the second elongated member of the first pair of scissors, the standoff element removably coupling the second elongated member of the first and second pairs of scissors together.

8. The cutting tool of claim 1, further comprising a fourth pair of scissors offset from the third pair of scissors by a third fixed distance.

9. A cutting tool comprising:

a first pair of scissors;

a second pair of scissors offset from the first pair of scissors by a first distance;

a third pair of scissors offset from the second pair of scissors by a second distance; and a retaining member coupled to each pair of scissors to secure the pairs of scissors together, wherein each pair of scissors comprises a first elongated member and a second elongated member pivotally coupled to the first elongated member, each elongated member including a handle portion and a cutting portion having a cutting blade, and wherein the retaining member is coupled to the first elongated member of each pair of scissors, such that the second elongated member of each pair of scissors is movable independent of the other pairs of scissors.

10. The cutting tool of claim 9, wherein the retaining member is coupled to the handle portion of the first elongated member of each pair of scissors.

11. The cutting tool of claim 9, wherein the first distance is equal to the second distance.

12. The cutting tool of claim 9 further comprising:

a first spacing element disposed between the first and second pairs of scissors to offset the second pair of scissors from the first pair of scissors; and a second spacing element disposed between the second and third pairs of scissors to offset the third pair of scissors from the second pair of scissors.

13. The cutting tool of claim 12, wherein the first and second spacing elements are coupled to the handle portions of the first elongated members of the pairs of scissors.

14. The cutting tool of claim 9, further comprising a standoff element mounted at one end to the second elongated member of the second pair of scissors and removably coupled at the other end to the second elongated member of the first pair of scissors, the standoff element securing the second elongated member of the first and second pairs of scissors together.

15. The cutting tool of claim 9, further comprising a fourth pair of scissors offset from the third pair of scissors by a third fixed distance.

16. A method of cutting and styling hair comprising:

directing a cutting tool along the length of a section of hair, the cutting tool including at least three pairs of scissors, the at least three pairs of scissors being spaced apart in parallel and means for connecting the at least three pairs of scissors together, each pair of the at least three pairs of scissors being capable of moving independent of the other pairs of scissors; and cutting a portion of the section of hair with the cutting tool.

17. The method of claim 16, wherein directing the cutting tool includes directing the cutting tool from a top of the section of hair toward a bottom of the section of hair.

18. The method of claim 16, wherein directing the cutting tool includes directing the cutting tool from a bottom of the section of hair toward a top of the section of hair.

19. The method of claim 16, further comprising:

rotating the cutting tool such that the at least three pairs of scissors are transverse to the section of hair; and cutting another portion of the section of hair, such that hair along an inner portion of the section is longer than hair along an outer portion of the section.

20. The method of claim 16, wherein cutting a portion of the section of hair includes moving each of the at least three pairs of scissors independent of the other pairs of scissors.

* * * * *